United States Patent [19]

Wu

[11] 4,320,637

[45] Mar. 23, 1982

[54] KEY REMOVABLE CYLINDER ASSEMBLY FROM LOCKET

[75] Inventor: Ming Y. Wu, Tainan, Taiwan

[73] Assignee: Jim Yu, Huntington Beach, Calif.

[21] Appl. No.: 133,500

[22] Filed: Mar. 21, 1980

[51] Int. Cl.[3] ..... E05B 13/10

[52] U.S. Cl. ..... 70/224; 70/369; 70/DIG. 39

[58] Field of Search ..... 70/369, 224, 367, 389, 70/DIG. 31, DIG. 39, 371

[56] References Cited

U.S. PATENT DOCUMENTS

| | | | |
|---|---|---|---|
| 1,979,938 | 11/1934 | Jacobi | 70/369 |
| 2,007,350 | 7/1935 | Schlage | 70/224 |
| 2,023,941 | 12/1935 | Voight | 70/224 |
| 2,046,630 | 7/1936 | Jacobi | 70/369 |
| 2,082,351 | 6/1937 | Moore | 70/224 |
| 2,677,953 | 5/1954 | Fisler | 70/224 |
| 3,196,644 | 7/1965 | Russell | 70/224 |
| 3,399,555 | 9/1968 | Gray | 70/369 |

*Primary Examiner*—Robert L. Wolfe

*Attorney, Agent, or Firm*—Singer & Singer

[57] ABSTRACT

A cylinder assembly complete with cylinder plug is located within the outside door handle of a lockset. A washer having a diameter greater than the diameter of the plug is mounted on the rearmost portion of the plug so as to form a shoulder portion. A slot is cut in the shoulder portion flush with the outside diameter of the plug. A spindle extending into the outside handle portion contains a boss on the inside portion extending radially towards the center of the handle a discrete portion substantially equal to the shoulder formed by the washer attached to the plug. The boss is located on the spindle side closest to the latch. The complete cylinder assembly is inserted into the outside handle with the door handle turned in a first direction and the plug rotated by the key in the opposite direction thereby turning the tailpiece until the slot on the shoulder is aligned with the boss on the spindle. The cylinder assembly is pushed in place and the door handle released allowing the key in the plug to rotate in the opposite direction thereby establishing the boss in front of the shoulder and locking the cylinder assembly in place. The key is removable and the lock set operated in the normal fashion.

11 Claims, 11 Drawing Figures

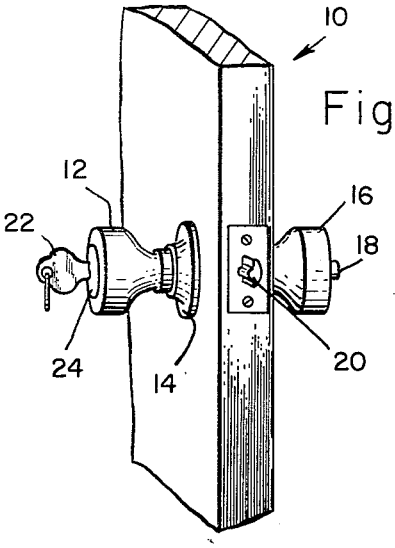
Fig. 1.
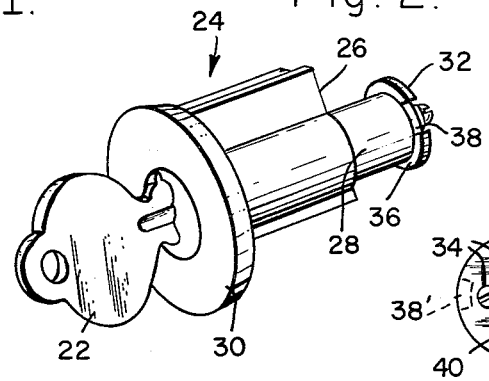
Fig. 2.
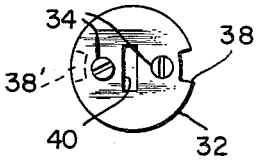
Fig. 3.
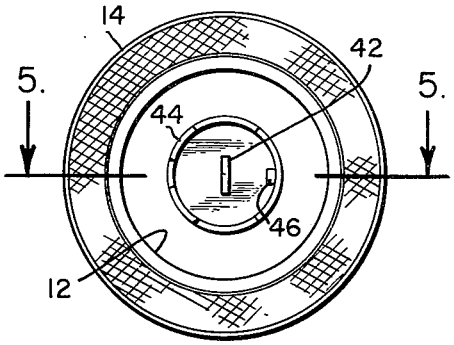
Fig. 4.
Fig. 5.
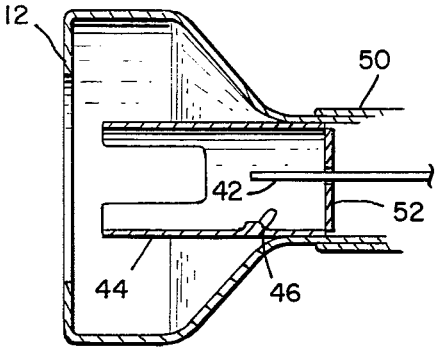
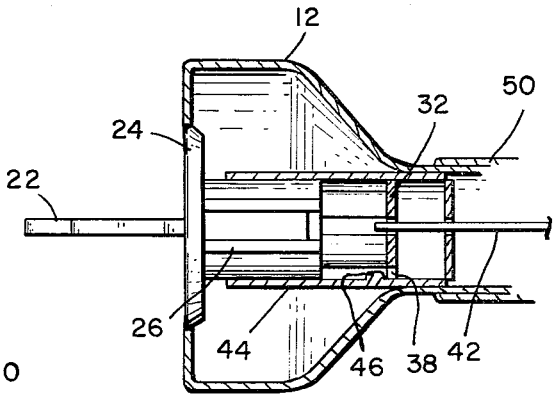
Fig. 6.
Fig. 7.
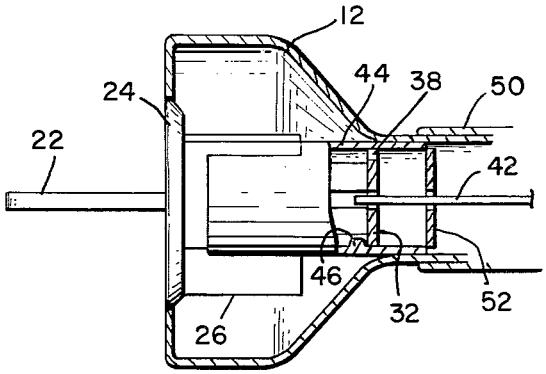

KEY REMOVABLE CYLINDER ASSEMBLY FROM LOCKET

This invention relates to a lockset and more particularly to a method and apparatus in which the cylinder and plug assembly may be removed and replaced by using only the key and without dismantling the lock set or utilizing special tools.

There is a strong felt need in the market place for a lockset in which the cylinder and plug assembly may be conveniently changed and without the need of special tools.

Hotel and innkeepers have a need to replace the cylinder and plug assembly periodically in order to insure the security of the rooms that are rented to the general public.

Construction people have a need to change the cylinder and plug assembly in the doors of buildings under construction, again to protect the security of the building under construction and to also conveniently change the cylinder and plug assemblies when the building is ultimately consigned to the user and ultimate operator who must of necessity again change the cylinder and plug assemblies in order to insure security of the building.

There have been attempts by the prior art to solve this problem in many varying and different ways.

For example, many of the prior art devices construct a lockset in which the cylinder and plug assembly are locked within the outer knob of the lockset. These devices invariably require disassembly of the lockset and removal of the outer knob in order to replace the cylinder and plug assembly.

Devices of this type are exemplified in the W. F. Moore U.S. Pat. No. 2,082,351, W. R. Schlage U.S. Pat. No. 2,007,350, L. H. Fisher, et al. U.S. Pat. No. 2,677,953, and F. J. Russell, et al. U.S. Pat. No. 3,196,644.

These patents have produced workable devices that have found limited commercial success in allowing the proprietor to replace the cylinder and plug assembly by first dismantling the outer knob and then removing the cylinder and replacing it with a new cylinder and plug assembly.

The different patents cited represent different and various techniques for removing the outer knob and represent the state of the art in attempting to simplify the procedure in first removing the knob and then simplifying the procedure for removing and replacing the cylinder and plug assembly.

In the present invention the outer knob is not removed but rather the key utilized to unlock the lock set is the only tool used to either remove the cylinder and plug assembly or to replace a new cylinder and plug assembly.

A review of the prior art shows still another technique for solving the problem which is to use different keys, one for opening and closing the door and the other specially designed to remove the cylinder and plug assembly. In one lock set manufactured by Norris Industries, a separate key is used for removing the cylinder and plug assembly. The separate key is usually slightly longer than the guest key and when inserted pushes against a spindle that releases the tail piece and allows the cylinder and plug assembly to be removed.

In still other systems dual plug assemblies are used in which one plug assembly is used only by the manager or landlord for removing the cylinder and plug assemblies. These systems are obviously complex, expensive, and have not found wide commercial success because of the complexity of the system and the need for two key assemblies and two separate keys.

In the present invention there is disclosed a lock set having a retractor housing and slide located in a door for controlling a door latch. An outer knob contains a cylinder and plug assembly mounted on a spindle located in the outer knob and in which the spindle is movably attached to the retractor mechanism.

A conventional inside knob with movable locking device such as a locking push button is used for preventing rotation of the tractor when security of the lock set is desired. A tail piece extends from the retractor into the outer knob and is used for independently controlling the retractor in the usual sense.

The cylinder and plug assembly are attached together and a washer having a central opening for accepting the tail piece is removably attached to the end portion of the plug. The washer preferably has a diameter greater than the diameter of the plug and in this way forms a shoulder which is ultimately used to lock the cylinder and plug assembly in place. A selected portion of the shoulder has a reduced diameter and in the preferred embodiment is in the form of a slot.

A boss is located on the inside diameter of the spindle and faces towards the center of the outer knob. The boss is preferably located on the inside diameter of the spindle closest to the slide mechanism on the door. The height of the boss is approximately that of the shoulder on the washer attached to the cylinder plug.

The cylinder and plug assembly is inserted in such a way that the slot on the washer passes over the boss when the cylinder and plug assembly is inserted into the outer knob. Once the cylinder and plug assembly is locked in place the boss is located in front of the shoulder thereby preventing the cylinder and plug assembly from being removed.

The cylinder and plug assembly is removed from the outer knob by first unlocking the lock set either by turning the inside knob or by using the key on the outside. The outer knob is then rotated in a first direction and the key is inserted into the cylinder. The key is rotated in the opposite direction that the outer knob was first rotated and in doing so the key and the cylinder and plug assembly can now be removed as a unit.

The outer knob may be rotated in the first instance in either a clockwise or counter-clockwise direction, but in so doing it is necessary that the key be rotated in the opposite direction that the outer knob is first rotated in.

The preferred method of inserting the cylinder and plug assembly is achieved by first unlocking the lock set. Since the cylinder and plug assembly are removed, it is only necessary to rotate the inner knob to thereby release the locking mechanism preventing rotation of the retractor.

The key is removed from the cylinder and plug assembly and the cylinder and plug assembly inserted into the outer knob with the cylinder pins vertical above the key position.

The outer knob is then rotated in a preferred direction which may either be clockwise or counter-clockwise. The key is then inserted into the keyway and rotated in the opposite direction which in this case would be counter-clockwise or clockwise. In this position the slot on the washer is aligned with the boss on the spindle and the cylinder and plug assembly may be pushed into the outer handle while the slot passes over the boss. The outer handle is released and the key returned in the original preferred direction that the knob was originally turned in. The key is then removed and the cylinder and plug assembly are now locked in place with the boss and the slot located 180 degrees from each other.

Further objects and advantages will be made more apparent by referring now to the accompanying drawings wherein:

FIG. 1 illustrates a lockset on a conventional door;

FIG. 2 illustrates a combined cylinder and plug assembly in the removed position;

FIG. 3 illustrates an end view of FIG. 2 illustrating the notched washer;

FIG. 4 is a front view of the outer knob illustrating the cylinder and plug assembly removed;

FIG. 5 is a cross-section of FIG. 4;

FIG. 6 is a cross-section of FIG. 4 illustrating the cylinder and plug assembly being inserted or withdrawn;

FIG. 7 is a cross-section of FIG. 4 illustrating the cylinder and plug assembly in a locked position within the outer knob;

Figure 8:
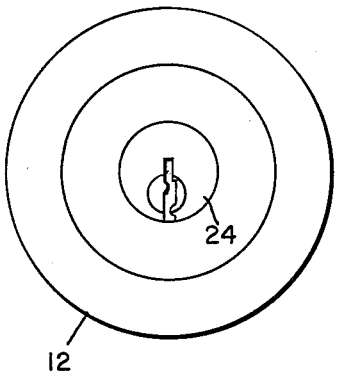
FIGS. 8, 9 and 10 illustrate the outer knob position in removing the cylinder and plug assembly.

Referring now to FIG. 1, there is shown a door 10 containing a conventional retractor housing and slide located within the door and mounted transverse to the door is an outer knob 12 and rosette assembly 14 and inner knob 16 having a conventional push button locking device 18. A latching device 20 is attached to the edge of the door and internally controlled by the retractor housing not illustrated. A key 22 is shown inserted into the cylinder and plug assembly 24 located within the outer knob 12.

Referring now to FIG. 2 there is shown a cylinder and plug assembly 24 comprising a cylinder portion 26 containing a plurality of pins and a rotatable plug portion 28 rotatably mounted within the cylinder assembly 26. The cylinder 26 is fixedly attached to a face plate 30 which is a decorative bezel and forms the front portion of the outer knob 12 illustrated in FIG. 1.

A key 22 is shown inserted into the plug 28 which is now free to rotate around the cylinder housing 26. The opposite end of the plug 28 contains a washer 32 that is attached to the end portion of the plug 28 preferably by a pair of screws 34 more fully illustrated in FIG. 3. The washer 32 has an outside diameter greater than the outside diameter of the plug 28 thereby forming a shoulder 36. The reduced portion on the periphery of the washer 32 and preferably in the form of a notch 28 is located on a small portion of the washer 32 and contains a reduced diameter portion approximating the diameter of the plug 28.

Referring now to FIG. 3, there is shown an end view of plug 28 illustrating screws 34 holding washer 32 in place. Screws 34 are symmetrically located in order to allow washer 32 to be removed and replaced 180 degrees from its original position so that notch 38 may be located at the position indicated by notch 38 prime.

The end view of FIG. 3 of the washer 32 also illustrates the rectangular opening 40 which is adapted to receive the tail piece extending from the retractor housing into the outer knob 12.

Referring now to FIG. 4, there is shown a front view of the outer knob 12 as illustrated in FIG. 1 with the cylinder and plug assembly 24 removed.

In this position one sees the rosette 14, the outer knob 12 and centrally located is the rectangular tail piece 42 which is adapted to mate within rectangular slot 40 of washer 32 illustrated in FIG. 3.

Located within the outer knob 12 is a spindle assembly 44 arranged and adapted to hold the cylinder and plug assembly 24 when properly inserted.

Located on the inside periphery of the spindle 44 is a boss 46. The boss 46 faces the center of the outer knob and is located on the inside diameter of the spindle on the side closest to the latch 20 as illustrated in FIG. 1. The height of the projection of the boss 46 is no greater than the height of the shoulder 36 formed by the washer 32 when connected to the plug 28. The notch 38 located on the washer 32 is sized to allow the boss 46 to pass through the notch 38 when properly aligned for insertion or removal of the cylinder and plug assembly.

When properly assembled, the boss 46 will be located behind the shoulder 36 so as to maintain the cylinder and plug assembly within the outer knob 12.

Upon removal, the notch 38 will be aligned with the boss 46 thereby allowing the cylinder and plug assembly to be removed.

Referring now to FIG. 5, there is shown a cross-section of the outer knob 12 taken along lines 5—5 of FIG. 4.

A shaft housing 50 provides the support for holding and maintaining the outer knob 12 in position. The outer knob 12 is physically attached to the spindle 44 and is adapted to rotate within the shaft housing. The tail piece 42 is supported in place by means of a suitable washer 52 that also has a substantially rectangular hole in it for holding the end piece of the tail piece 42 in position. The boss 46 is illustrated on the inside diameter of the spindle 44.

Referring now to FIG. 6, there is shown a cross-section of the outer knob 12 illustrating the cylinder and plug assembly inserted in a nesting position. In this position the notch 38 on the washer 32 is passing over the boss 46 located on the spindle 44. The rectangular opening 40 located in the washer 32 is shown accepting the end of the tail piece 42.

The position illustrated in FIG. 6 is not a locked position but rather is only the last step of the inserted position since in this position the cylinder and plug assembly may be inserted or removed and as illustrated there is nothing to hold the assembly in place.

Referring now to FIG. 7, there is shown a cross-section of the outer knob 12 illustrating the cylinder and plug assembly 24 locked in place with the washer 32 located behind the boss 46. In this position the notch 38 is located 180 degrees away from the boss 46 and the tail piece 42 is inserted into the opening in the washer 32.

In the position illustrated, the cylinder and plug assembly is locked in place and rotating the outer knob 12 will rotate the spindle 44 causing the retractor housing to be rotated.

Inserting the key 22 into the cylinder and plug assembly 24 will cause the plug 28 to be rotated thereby rotating washer 32 and rotating tail piece 42 also operating the retractor housing. Should the push button 18 illustrated in FIG. 1 be pushed, the conventional locking mechanism for preventing rotation of the retractor housing will be energized thereby effectively preventing rotation of the outer housing 12 and the spindle 44.

Inserting the key 22 and rotating the key will directly rotate the tail piece 42 and unlatch the locking mechanism in the conventional manner.

Figure 9:
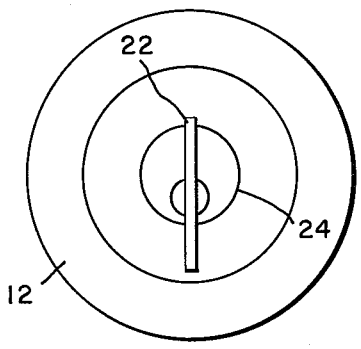
Figure 10:
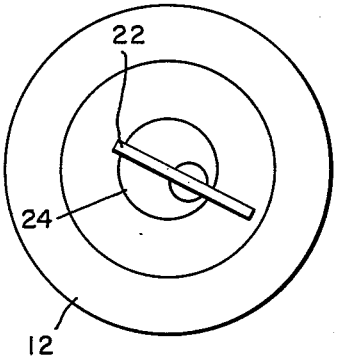

In order to more fully appreciate the method of removing the cylinder and plug assembly, reference is now made to FIGS. 8, 9 and 10.

FIG. 8 illustrates a front view of the outer knob 12 in the normal condition before a key is inserted.

In FIG. 9 a key 22 is inserted and if rotated either to the left or to the right, the door will be unlocked in the conventional fashion. Inserting the key 22 into the keyway will allow the plug 28 to be rotated freely of the cylinder housing and since the washer 32 rotates the tail piece, it will be appreciated that rotating the key 22 either left or right will have the effect of rotating the plug 28, rotating the washer 32, rotating the tail piece 42, thereby causing the retractor housing to rotate and release the latch. The internal mechanism is essentially that as shown in FIG. 7.

Referring now to FIG. 10, we see the first step necessary to remove the cylinder and plug assembly by first rotating the outer housing 12 in a counter-clockwise direction. The outer knob 12 must be held in that position and in so doing the key 22 will also rotate to the extreme position as illustrated. The next step is to rotate the key to the right as far as it will rotate which then places the notch 38 on the washer 32 in an alignment position with the boss 46 as shown in FIG. 6. In this position the key and the cylinder and plug assembly can be removed as a unit since there is nothing to hold the assembly within the outer knob 12.

A review of FIG. 4 will show what the outer knob 12 looks like with the cylinder and plug assembly 26 removed.

Replacing the cylinder and plug assembly must be done in such a way so as to ensure that the tail piece 42 is rotated and that the slot 38 in the washer 32 does not end up on the same side as the boss 46. If this were done, the cylinder and plug assembly would not be held in position and could fall out.

Figure 11:
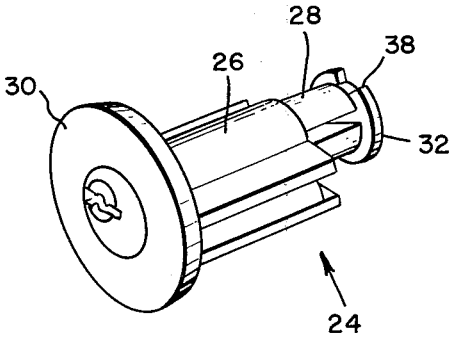
FIG. 11 illustrates the preferred position of the cylinder and plug assembly prior to insertion in the outer knob.

In order to ensure that the cylinder and plug assembly is inserted correctly, it is first necessary that the cylinder and plug assembly 26 be locked together as shown in FIG. 11 and the key removed.

A review of FIG. 11 will show that the key's way for accepting the key is in the bottommost portion of the bezel 30 and, further, that the notch 38 is on the left side with the plug 28 locked within the cylinder 26.

The cylinder and plug assembly 24 is then inserted into the opened outer knob 12 as shown in FIG. 4 with the keyway in the lowermost portion which thereby places the cylinder pins in a vertical position above the keyway and the notch 38 in the washer on the left side.

In this position the notch 38 is on the left and the boss 46 is on the right and it will be impossible to push the cylinder and plug assembly all the way in because of the interference of the boss 46 against the shoulder 36 formed by the washer 32.

At this point the key is inserted into the keyway of the cylinder and plug assembly and the outer knob is rotated counter-clockwise and held in that position. In this position it will be appreciated that the tail piece 42 is inserted in the rectangular opening 40 located in the washer 32 even though the complete cylinder and plug assembly 24 is not fully inserted within the outer knob 12. Rotating the outer knob 12 counter-clockwise rotates the spindle 44, the cylinder and plug assembly 24, the tail piece 42, thereby rotating the retractor housing.

The outer knob 12 is held in this position and the key 22 having been inserted in the keyway is now rotated clockwise as far as it will go. At this position rotating the key rotates the plug 28 thereby rotating the washer 28 so that notch 38 is aligned with boss 46 at which point the complete cylinder and plug assembly is free to be pushed into the outer knob 12 and the situation will be as that illustrated in FIG. 6.

At this point in time, that is, still holding the outer knob 12 counter-clockwise and key 22 clockwise has not locked the cylinder and plug assembly in place yet, but only aligned the notch 38 with the boss 46.

The last step is to release the outer knob 12 thereby allowing it to rotate clockwise while at the same time turning the key counter-clockwise which now places the notch 38 180 degrees away from the boss 46 as shown in FIG. 7. The key can now be removed and simply inserting the key and turning it will have the effect of rotating the plug which in turn will rotate the tail piece 42 and operate the retractor mechanism.

It will be appreciated in reviewing the method of inserting the cylinder and plug housing and removing the cylinder and plug housing that the initial turn of the outer knob 12 may either be to the left or to the right with the only proviso being that the corresponding turn of the key must then be in the opposite direction to that as originally taken.

It will be appreciated by those skilled in the art that the actual notch on washer 32 may be of any preferred shape provided only that it cooperates with the shape of the boss actually used on the inside of the spindle. In addition, the locking device may either be a plunger as illustrated or may be a rotatable device as is common in the art today.

The lock set illustrated may be inserted either on a left opening door or a right opening door without changing the effect of the invention. In all cases it is preferred that the boss be located on the inside of the spindle and on the side closest to the latch. For an opposite opening door it is only necessary to remove the symmetrical screws 34 illustrated in FIG. 3 and reverse the washer 32 180 degrees thereby placing the notch 38 on the opposite side. In this fashion the invention has wide applicability to left door or right door positionings.

I claim:

1. In a lockset having a retractor housing and slide located in a door for controlling a door latch, an outer knob having a cylinder and plug assembly mounted on a spindle located in the outer knob and movably attached to the retractor, an inside knob with movable locking device for preventing rotation of the retractor and a tailpiece extending from the retractor into the outer knob for independently controlling the retractor, the improvement comprising:

a washer having a central opening for accepting the tailpiece and removably attached to the end portion of the cylinder plug, said washer having a diameter greater than the diameter of the plug thereby forming a shoulder, a selected portion of said shoulder having a reduced diameter, and a boss located on the inside diameter of said spindle facing towards the center of the outer knob and having a height approximating that of the shoulder on said washer whereby the cylinder and plug assembly is inserted in the outer knob and locked in place.

2. In a lockset according to claim 1 in which the tailpiece is rectangular and the washer has a central opening that is rectangular.

3. In a lockset according to claim 1 in which said washer is held to the plug assembly by a pair of symmetrically located holding devices whereby said washer has a first and second preferred position that is 180 degrees apart.

4. In a lockset according to claim 1 in which said washer has a notch on one side of the shoulder portion for accepting the boss on said spindle.

5. A lockset with key removable cylinder and plug assembly comprising:

a washer having a central opening adapted to accept a tailpiece and attached to the end portion of a cylinder plug, said washer having a diameter greater than the diameter of the plug thereby forming a shoulder, a selected portion of said shoulder having a reduced diameter, and a boss located on the inside diameter of a spindle located within an outer knob and facing toward the center of the outer knob and having a height approximating that of the shoulder on said washer whereby a cylinder and plug assembly may be inserted in the outer knob with the tailpiece engaged and locked in place.

6. In a lockset having a retractor housing and slide located in a door for controlling a door latch, an outer knob having a cylinder and plug assembly mounted on a spindle located in the outer knob and movably attached to the retractor, an inside knob with movable locking device for preventing rotation of the retractor and a tailpiece extending from the retractor into the outer knob for independently controlling the retractor, the method of removing the cylinder and plug assembly with only the operating key comprising the steps of:

first unlocking the lockset, rotating the outer knob in a first direction, inserting the key into the cylinder, rotating the key in the opposite direction, and then removing key and cylinder plug assembly as a unit.

7. The method according to claim 6 in which the lockset is unlocked either by a key from the outside or by turning the inner knob from the inside.

8. The method according to claim 6 in which the outer knob is rotated clockwise and the key is rotated counter-clockwise.

9. The method according to claim 6 in which the outer knob is rotated counter-clockwise and the key is rotated clockwise.

10. In a lockset having a retractor housing and slide located in a door for controlling a door latch, an outer knob having a cylinder and plug assembly mounted on a spindle located in the outer knob and movably attached to the retractor, an inside knob with movable locking device for preventing rotation of the retractor and a tailpiece extending from the retractor into the outer knob for independently controlling the retractor, the method of inserting the cylinder and plug assembly with only the operating key comprising the steps of:

first unlocking the lockset by rotating the inner knob, removing the key from the cylinder and plug assembly and inserting the cylinder and plug assembly into the outer knob with the cylinder pins vertically above the key position, rotating the outer knob in a preferred direction, inserting the key and rotating the key in the opposite direction, pushing the cylinder and plug assembly into the outer handle, releasing the outer handle and turning the key in the original preferred direction, and then removing the key.

11. A method according to claim 10 in which the outer knob is first turned counter-clockwise, then the key is turned clockwise, then the outer knob is released and the key is turned counter-clockwise.

* * * * *